US011426847B2

(12) United States Patent
Lai

(10) Patent No.: US 11,426,847 B2
(45) Date of Patent: Aug. 30, 2022

(54) RATCHET WRENCH

(71) Applicant: Chiu-Ju Lai, Changhua (TW)

(72) Inventor: Chiu-Ju Lai, Changhua (TW)

( * ) Notice: Subject to any disclaimer, the term of this patent is extended or adjusted under 35 U.S.C. 154(b) by 0 days.

(21) Appl. No.: 17/147,361

(22) Filed: Jan. 12, 2021

(65) Prior Publication Data

US 2022/0219295 A1 Jul. 14, 2022

(51) Int. Cl.
*B25B 23/00* (2006.01)
*B25B 13/46* (2006.01)

(52) U.S. Cl.
CPC ..... *B25B 23/0035* (2013.01); *B25B 13/463* (2013.01)

(58) Field of Classification Search
CPC ..... B25B 23/0035; B25B 23/108; B25B 13/46–463; B25B 13/06; B25B 13/48; B25B 13/58
USPC ..... 81/58.2, 60, 61, 62, 63.1, 63.2, 125, 81/125.1, 177.85, 185; 192/46, 108, 71
See application file for complete search history.

(56) References Cited

U.S. PATENT DOCUMENTS

2007/0277652 A1* 12/2007 Tuan-Mu ..... B25B 13/06 81/63
2020/0147762 A1* 5/2020 Chang ..... B25B 23/0035

* cited by examiner

*Primary Examiner* — Orlando E Aviles
*Assistant Examiner* — Sidney D Hohl
(74) *Attorney, Agent, or Firm* — Che-Yang Chen; Law Office of Michael Chen

(57) ABSTRACT

A ratchet wrench may include a main body, a cylinder, a first sleeve, and a second sleeve. The main body has a head portion and a shank, and a first through hole horizontally penetrates through the head portion, and the cylinder is coupled in the first through hole. The inner peripheries of two ends of the cylinder respectively comprise continuous teeth to form a first tool hole and a second tool hole, and the first tool hole and the second tool hole can respectively receive a first sleeve and a second sleeve which respectively have a third tool hole and a fourth tool hole thereon. Also, the first sleeve and the second sleeve are detachable from the cylinder to install needed sleeves with different diameters of tool holes, which greatly increases the consumer purchasing intentions.

5 Claims, 11 Drawing Sheets

RATCHET WRENCH

FIELD OF THE INVENTION

The present invention relates to a hand tool and more particularly to a ratchet wrench that can detachably connect to different sizes of operating units.

BACKGROUND OF THE INVENTION

Referring to FIGS. 11 and 12, a conventional ratchet wrench comprises a head portion (50) which has a first through hole (51) penetrating therethrough, and the first through hole (51) is configured to receive a first cylinder (60). A first operating end (61) and a second operating end (62) are respectively formed at an upper end and a lower end of the first cylinder (60), and the first operating end (61) and the second operating end (62) are concaved axially to form a first operating hole (611) and a second operating hole (621) respectively. The first cylinder (60) is axially penetrated by a first channel (63) between the first operating hole (611) and the second operating hole (621), and a middle portion of the first channel (63) comprises an annular groove (631) formed on an inner wall thereof. The first cylinder (60) is adapted to receive a second cylinder (70), and a fourth operating end (71) is formed at an end of the second cylinder (70) while the other end thereof is extended to form a connecting rod (72). An end of the connecting rod (72) has an engaging head (73), and a middle portion of the connecting rod (72) comprises a locating groove (721) formed on the outer periphery thereof. Moreover, the outer periphery of the engaging head (73) has a first engaging groove (731). The engaging head (73) is adapted to engage with a second engaging groove (81) of a third operating end (80), a C-shape ring (732) is configured to couple on the first engaging groove (731) to secure the third operating end (80) with the engaging head (73). Additionally, the third operating end (80) and the fourth operating end (71) are concaved axially to form a third operating hole (82) and a fourth operating hole (711) respectively. When the third operating hole (82) and the fourth operating hole (711) are needed, the second cylinder (70) is positioned at the middle portion of the first cylinder (60). On the other hand, when the first operating hole (611) and the second operating hole (621) are needed, the second cylinder (70) is selectively pushed inwardly to make the first operating hole (611) and the second operating hole (621) available, so as to enable the single ratchet wrench to have four different sizes of operating holes.

However, the conventional ratchet wrench has following disadvantages: (i) the fourth operating end (71) is formed integrally with the second cylinder (70), and the third operating end (80) is secured on the first engaging groove (731) of the second cylinder (70) through the C-shape ring (732), such that the third operating end (80) and the fourth operating end (71) are not able to be detached and replaced to different sizes. Therefore, there remains a need for a new and improved design for a ratchet wrench to overcome the problems presented above.

SUMMARY OF THE INVENTION

The present invention provides a ratchet wrench comprising a main body, a cylinder, a first sleeve, and a second sleeve. The main body has a head portion and a shank, and a first through hole horizontally penetrates through the head portion. The inner periphery of the first through hole has an accommodating slot at a position corresponding to the shank, and two lateral sides of the shank adjacent to the head portion respectively comprise two second through holes communicated with the accommodating slot. A first teeth portion is installed in the accommodating slot through a pivot, and two ends of the first teeth portion respectively protrude out from the two second through holes to enable a user to pull to adjust the position of the first teeth portion. The cylinder is coupled in the first through hole, and the middle portion of the outer periphery of the cylinder has a second teeth portion, and the second teeth portion having continuous teeth formed of a loop is adapted to engage with the first teeth portion. The inner peripheries of two ends of the cylinder respectively comprise continuous teeth to form a first tool hole and a second tool hole, which are formed in different diameters. An annular blocking protrude is formed at the middle portion of the inner periphery of the cylinder, and a first groove and a second groove are respectively formed between the blocking protrude and the first tool hole and between the blocking protrude and the second tool hole. The inner diameter of the first groove is larger than both of that of the first tool hole and that of the blocking protrude, and the inner diameter of the second groove is larger than both of that of the second tool hole and that of blocking protrude, and a spring is received in the cylinder. The first sleeve comprises a first outer teeth and a first annular surface on the outer periphery thereof, and the first outer teeth has continuous teeth formed of a loop. The inner periphery of the first sleeve comprises continuous teeth to form a third tool hole. The first sleeve is coupled in the first tool hole, and the first outer teeth is engaged with the continuous teeth of the first tool hole. The outer diameter of the first annular surface is smaller than that of the first outer teeth, and the first annular surface has at least a first slot thereon, and a first locating column is inserted into the first slot. The top end of the first locating column comprises a first blocking portion which has the outer diameter larger than that of the first locating column, and a non-circular first engaging hole is formed at the bottom end of the first locating column. A first elastic piece is disposed on the outer periphery of the first locating column, and the position of the first elastic piece is limited between the first blocking portion and the first annular surface, and the first locating column is pushed outwardly by the first elastic piece and limited between the first groove and the first slot, so that the first sleeve is slidably limited in the first tool hole. The second sleeve has a second outer teeth and a second annular surface on the outer periphery thereof, and the second outer teeth comprises continuous teeth formed of a loop. The inner periphery of the second sleeve has continuous teeth to form a fourth tool hole, and the third tool hole and the fourth tool hole have different diameters. The second sleeve is coupled in the second tool hole, and the second outer teeth is engaged with the continuous teeth of the second tool hole. The outer diameter of the second annular surface is smaller than that of the second outer teeth, and the second annular surface comprises at least a second slot thereon. A second locating column is inserted into the second slot, and the top end of the second locating column has a second blocking portion which has the outer diameter larger than that of the second locating column while a non-circular second engaging hole is formed at the bottom end of the second locating column. A second elastic piece is disposed on the outer periphery of the second locating column, and the position of the second elastic piece is limited between the second blocking portion and the second annular surface, and the second locating column is pushed outwardly by the second elastic piece and limited between the second groove and the second slot, so that the second sleeve is slidably limited in the second tool hole. The first annular surface and the second annular surface are respectively abutted against two ends of the spring so as to limit the spring in the cylinder.

In one embodiment, an inclined first guiding surface is connected between the first groove and the first tool hole while an inclined second guiding surface is connected between the second groove and the second tool hole.

In another embodiment, a blocking edge protrudes from the inner periphery of an end of the first through hole, and the other end of the first through hole comprises a first annular groove on the inner periphery thereof; the cylinder has an annular first protrude on the middle portion of the outer periphery thereof, and the second teeth portion and a second annular groove are respectively formed on the surface of the first protrude; one end of the first protrude is abutted against the blocking edge, and the second annular groove on the other end of the first protrude is aligned with the first annular groove, and a C-shape ring is coupled between the second annular groove and the first annular groove to secure the cylinder in the first through hole.

In still another embodiment, the first groove and the second groove have different inner diameters.

In a further embodiment, the first slot and the second slot, which are respectively on the first annular surface of the first sleeve and the second annular surface of the second sleeve, are located at corresponding positions, and the first locating column with the first elastic piece and the second locating column with the second elastic piece are respectively inserted into the first slot and the second slot.

Comparing with conventional ratchet wrench, the present invention is advantageous because: the ratchet wrench of the present invention not only has four different diameters of tool holes, but both of the first sleeve and the second sleeve are detachable from the cylinder to install needed sleeves with different diameters of tool holes, which greatly increases the consumer purchasing intentions.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
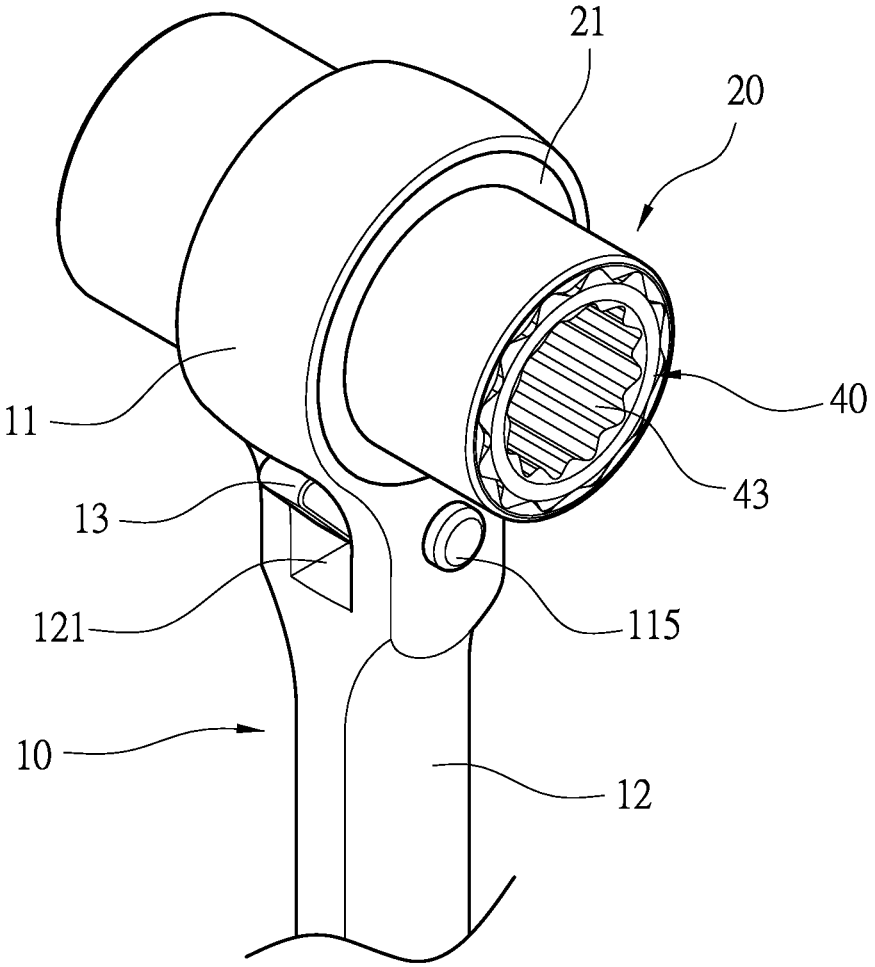
FIG. 1 is a three-dimensional assembly view of a ratchet wrench of the present invention.
Figure 2:
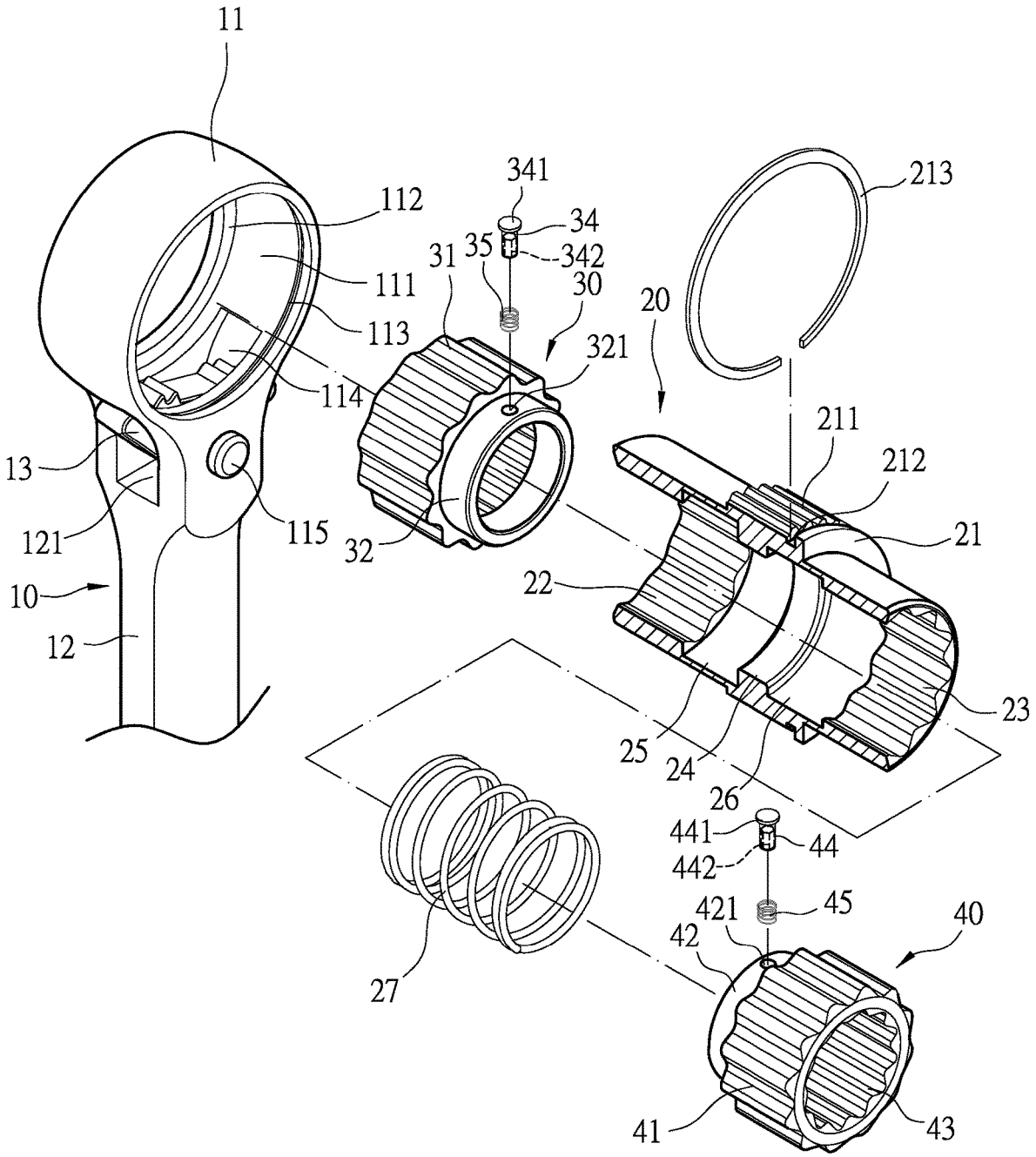
FIG. 2 is an exploded view of the ratchet wrench of the present invention.
Figure 3:
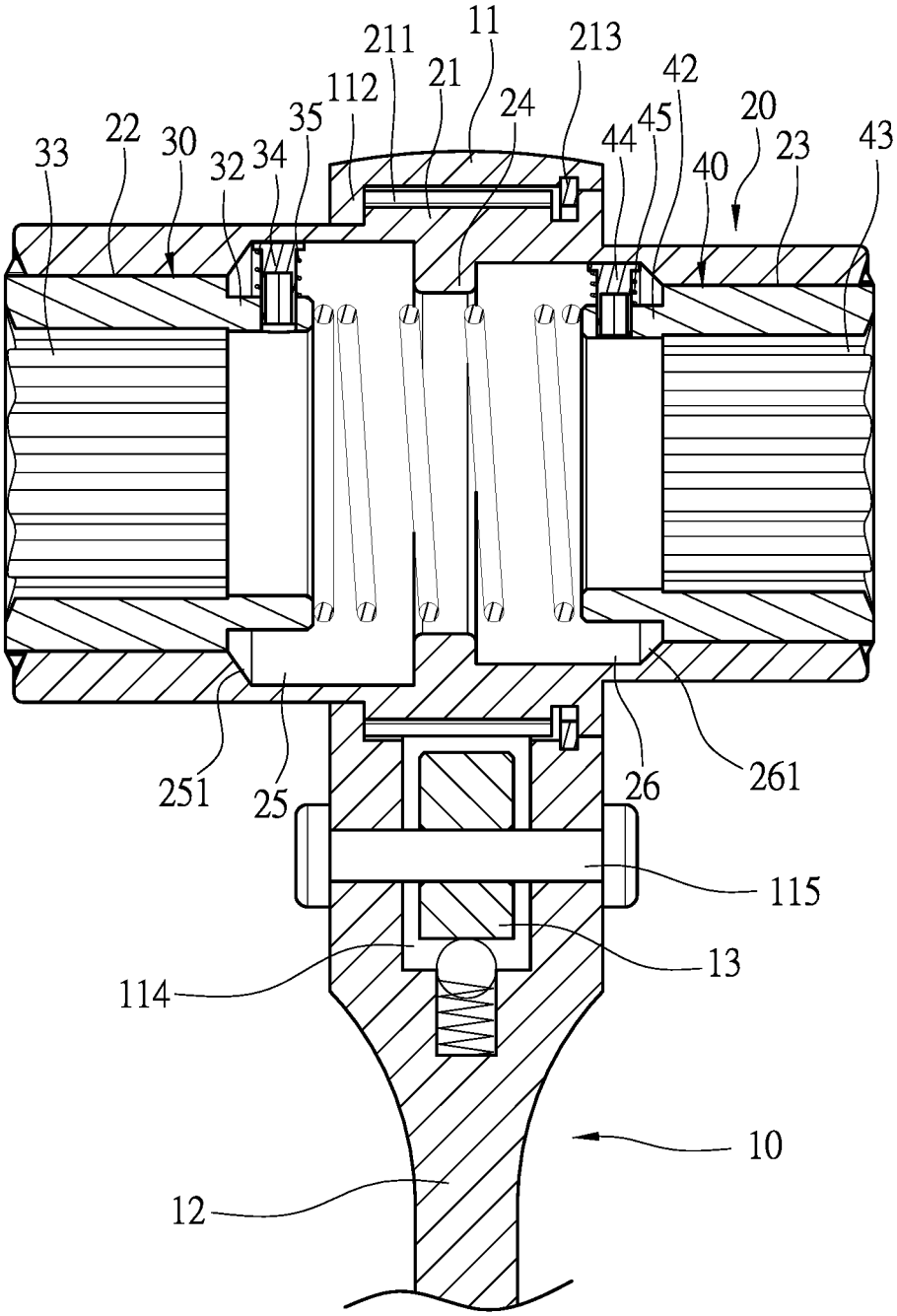
FIG. 3 is a sectional assembly view of the ratchet wrench of the present invention.

In order to further understand the goal, characteristics and effect of the present invention, a number of embodiments along with the drawings are illustrated as following:

Referring to FIGS. 1 to 3, the present invention provides a ratchet wrench comprising a main body (10), a cylinder (20), a first sleeve (30), and a second sleeve (40). The main body (10) has a head portion (11) and a shank (12), and a first through hole (111) horizontally penetrates through the head portion (11), and a blocking edge (112) protrudes from the inner periphery of an end of the first through hole (111), and the other end of the first through hole (111) comprises a first annular groove (113) on the inner periphery thereof. Moreover, the inner periphery of the first through hole (111) has an accommodating slot (114) at a position corresponding to the shank (12), and two lateral sides of the shank (12) adjacent to the head portion (11) respectively comprise two second through holes (121) communicated with the accommodating slot (114). A first teeth portion (13) is installed in the accommodating slot (114) through a pivot (115), and two ends of the first teeth portion (13) respectively protrude out from the two second through holes (121) to enable a user to pull to adjust the position of the first teeth portion (13). The cylinder (20) has an annular first protrude (21) on the middle portion of the outer periphery thereof, and a second teeth portion (211) and a second annular groove (212) are respectively formed on the surface of the first protrude (21). The second teeth portion (211) has continuous teeth formed of a loop, and the inner peripheries of two ends of the cylinder (20) respectively comprise continuous teeth to form a first tool hole (22) and a second tool hole (23), which are formed in different diameters. An annular blocking protrude (24) is formed at the middle portion of the inner periphery of the cylinder (20), and two different sizes of a first groove (25) and a second groove (26) are respectively formed between the blocking protrude (24) and the first tool hole (22) and between the blocking protrude (24) and the second tool hole (23). The inner diameter of the first groove (25) is larger than both of that of the first tool hole (22) and that of the blocking protrude (24), and an inclined first guiding surface (251) is connected between the first groove (25) and the first tool hole (22). The inner diameter of the second groove (26) is larger than both of that of the second tool hole (23) and that of blocking protrude (24), and an inclined second guiding surface (261) is connected between the second groove (26) and the second tool hole (23). Moreover, a spring (27) is received in the cylinder (20). The first sleeve (30) comprises a first outer teeth (31) and a first annular surface (32) on the outer periphery thereof, and the first outer teeth (31) has continuous teeth formed of a loop. The inner periphery of the first sleeve (30) comprises continuous teeth to form a third tool hole (33), and the outer diameter of the first annular surface (32) is smaller than that of the first outer teeth (31). Furthermore, the first annular surface (32) has at least a first slot (321) thereon, and a first locating column (34) is inserted into the first slot (321). The top end of the first locating column (34) comprises a first blocking portion (341) which has the outer diameter larger than that of the first locating column (34), and a non-circular first engaging hole (342) is formed at the bottom end of the first locating column (34). In addition, a first elastic piece (35) is disposed on the outer periphery of the first locating column (34), and the position of the elastic piece (35) is limited between the first blocking portion (341) and the first annular surface (32). The second sleeve (40) has a second outer teeth (41) and a second annular surface (42) on the outer periphery thereof, and the second outer teeth (41) comprises continuous teeth formed of a loop. The inner periphery of the second sleeve (40) has continuous teeth to form a fourth tool hole (43), and the third tool hole (33) and the fourth tool hole (43) have different diameters. Also, the outer diameter of the second annular surface (42) is smaller than that of the second outer teeth (41), and the second annular surface (42) comprises at least a second slot (421) thereon. A second locating column (44) is inserted into the second slot (421), and the top end of the second locating column (44) has a second blocking portion (441) which has the outer diameter larger than that of the second locating column (44) while a non-circular second engaging hole (442) is formed at the bottom end of the second locating column (44). Moreover, a second elastic piece (45) is disposed on the outer periphery of the second locating column (44), and the position of the second elastic piece (45) is limited between the second blocking portion (441) and the second annular surface (42).

Structurally, referring to FIGS. 2 and 3, the cylinder (20) is installed in the first through hole (111) of the head portion (11) of the main body (10), and one end of the first protrude (21) is abutted against the blocking edge (112), and the second teeth portion (211) of the first protrude (21) is engaged with the first teeth portion (13) in the accommodating slot (114). Furthermore, the second annular groove (212) on the other end of the first protrude (21) is aligned with the first annular groove (113), and a C-shape ring (213) is coupled between the second annular groove (212) and the first annular groove (113) to secure the cylinder (20) in the first through hole (111). The first sleeve (30) and the second sleeve (40) are respectively coupled in the first tool hole (22) and the second tool hole (23). The first locating column (34), which has the first elastic piece (35) disposed thereon, is inserted into the first slot (321), and the first elastic piece (35) is compressed to enable the first locating column (34) to be positioned in the first slot (321). Thereafter, the first sleeve (30) is coupled into the first tool hole (22) of the cylinder (20) through the end having the first annular surface (32), and the first outer teeth (31) is engaged with the continuous teeth of the first tool hole (22), and then the first elastic piece (35) is adapted to push the first locating column (34) outwardly so as to limit the position of the first locating column (34) between the first groove (25) and the first slot (321), so that the first sleeve (30) is slidably limited in the first tool hole (22), and the sliding range of the first sleeve (30) is defined corresponding to the wide of the first groove (25). The second locating column (44), which has the second elastic piece (45) disposed thereon, is inserted into the second slot (421), and the second elastic piece (45) is compressed to enable the second locating column (44) to be positioned in the second slot (421). Then, the second sleeve (40) is coupled into the second tool hole (23) of the cylinder (20) through the end having the second annular surface (42), and the second outer teeth (41) is engaged with the continuous teeth of the second tool hole (23), and thereafter the second elastic piece (45) is configured to push the second locating column (44) outwardly so as to limit the position of the second locating column (44) between the second groove (26) and the second slot (421), so that the second sleeve (40) is slidably limited in the second tool hole (23), and the sliding range of the second sleeve (40) is defined corresponding to the wide of the second groove (26). After the first sleeve (30) and the second sleeve (40) are respectively coupled into the first tool hole (22) and the second tool hole (23) of the cylinder (20), the first annular surface (32) and the second annular surface (42) are respectively abutted against two ends of the spring (27) so as to limit the spring (27) in the cylinder (20). Also, the spring (27) is configured to be compressed and balanced between the first sleeve (30) and the second sleeve (40).

Figure 4:
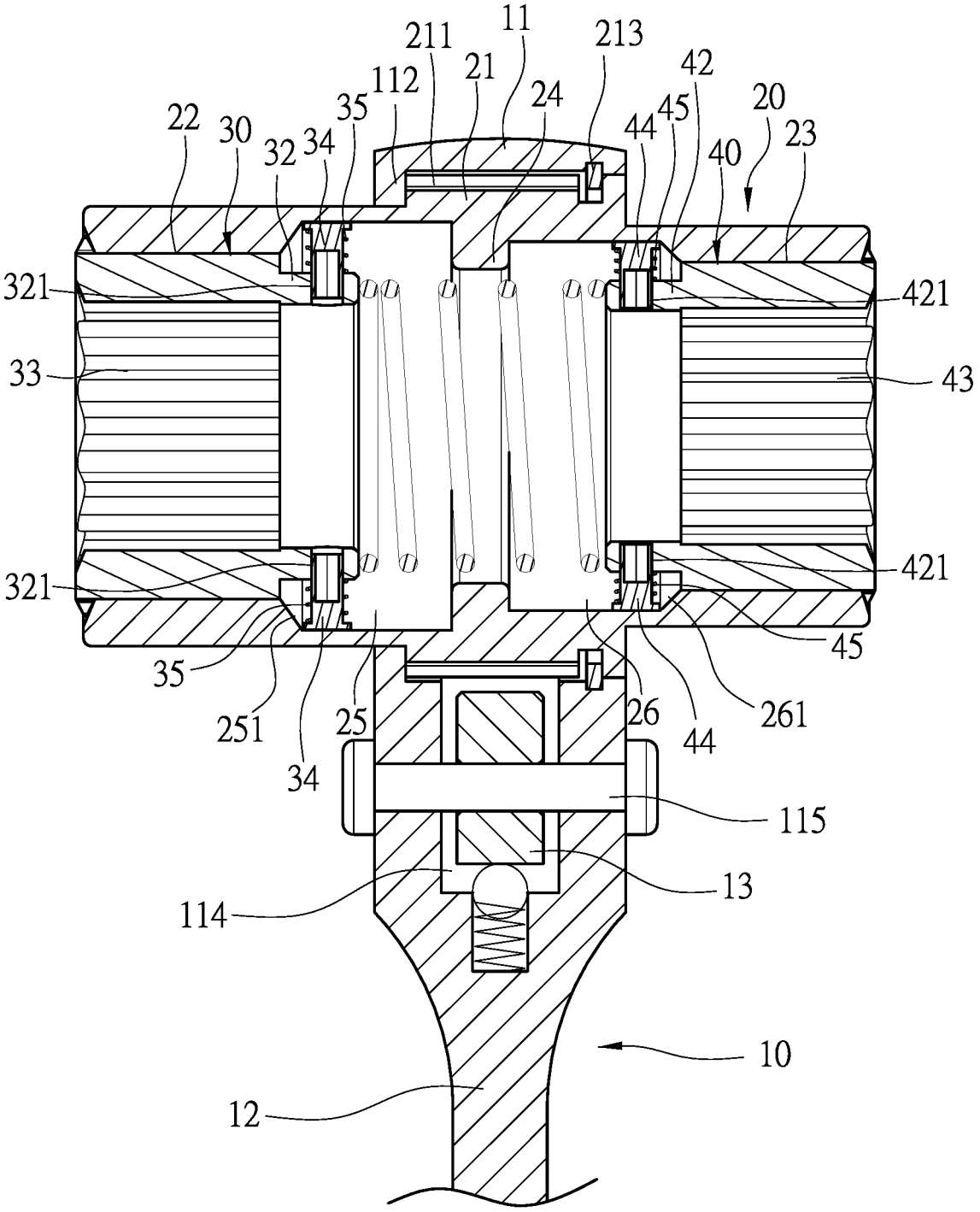
FIG. 4 is a sectional assembly view of another embodiment of the ratchet wrench of the present invention.

Additionally, referring to FIG. 4, the first slot (321) and the second slot (421), which are respectively on the first annular surface (32) of the first sleeve (30) and the second annular surface (42) of the second sleeve (40), are located at corresponding positions, and the first locating column (34) with the first elastic piece (35) and the second locating column (44) with the second elastic piece (45) are respectively inserted into the first slot (321) and the second slot (421). Through the first locating column (34) and the second locating column (44), the first sleeve (30) and the second sleeve (40) are respectively limited in the first groove (25) and the second groove (26) and are slidably limited in the first tool hole (22) and the second tool hole (23) respectively.

Figure 5:
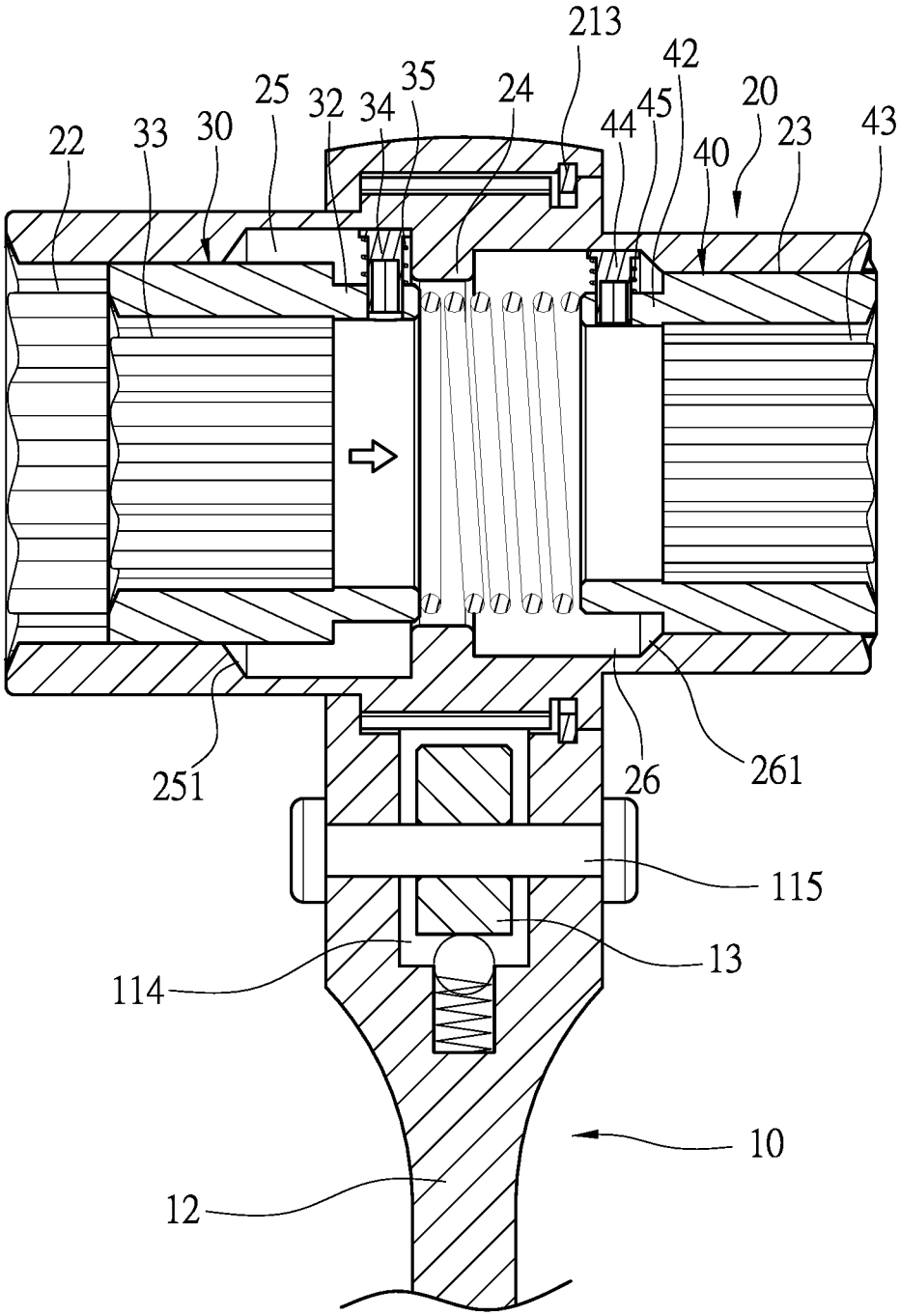
FIG. 5 is a schematic view illustrating a spring in a cylinder of the ratchet wrench is compressed in the present invention.
Figure 6:
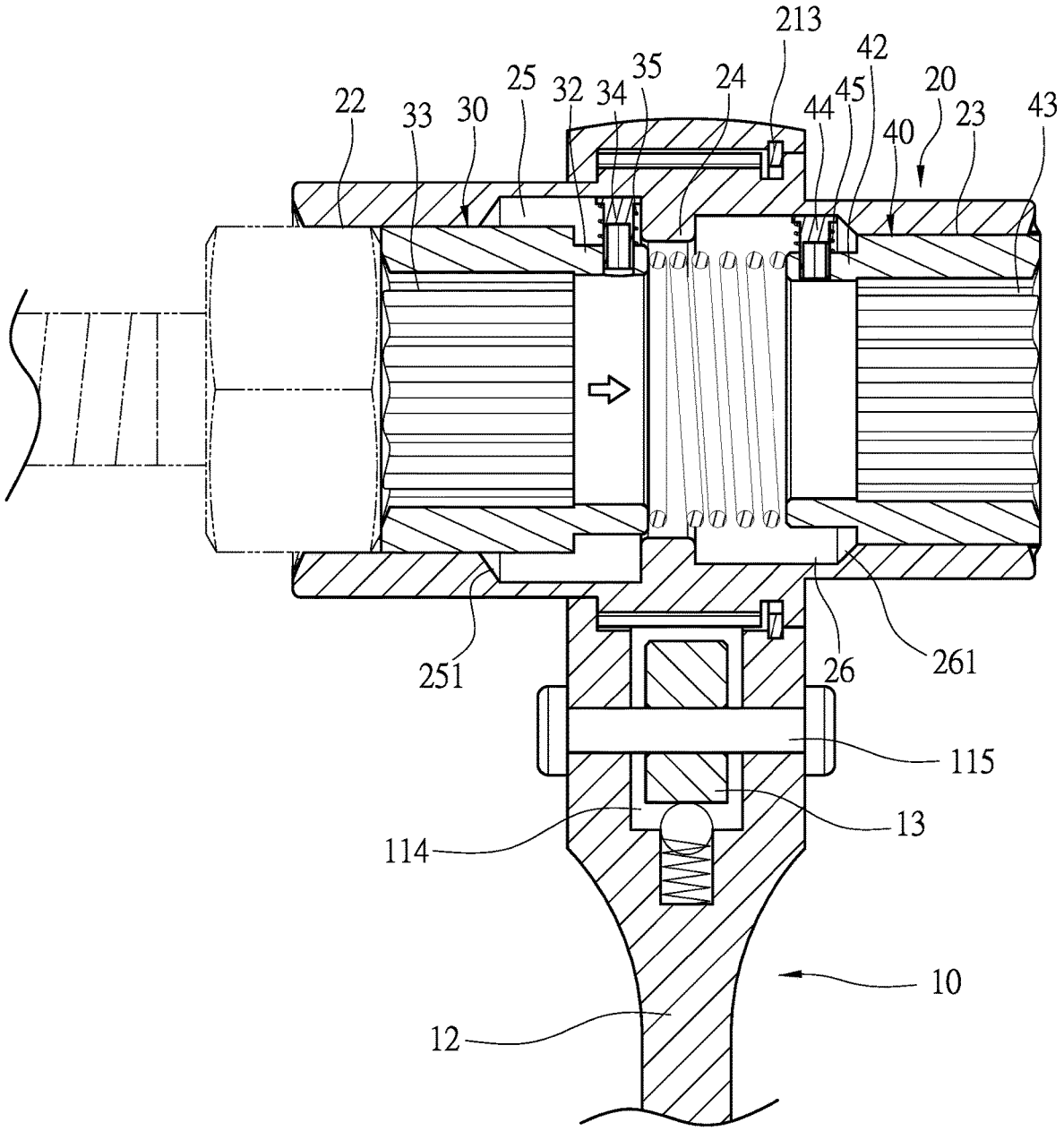
FIG. 6 is a schematic view illustrating a first tool hole of the ratchet wrench of the present invention is in use.
Figure 7:
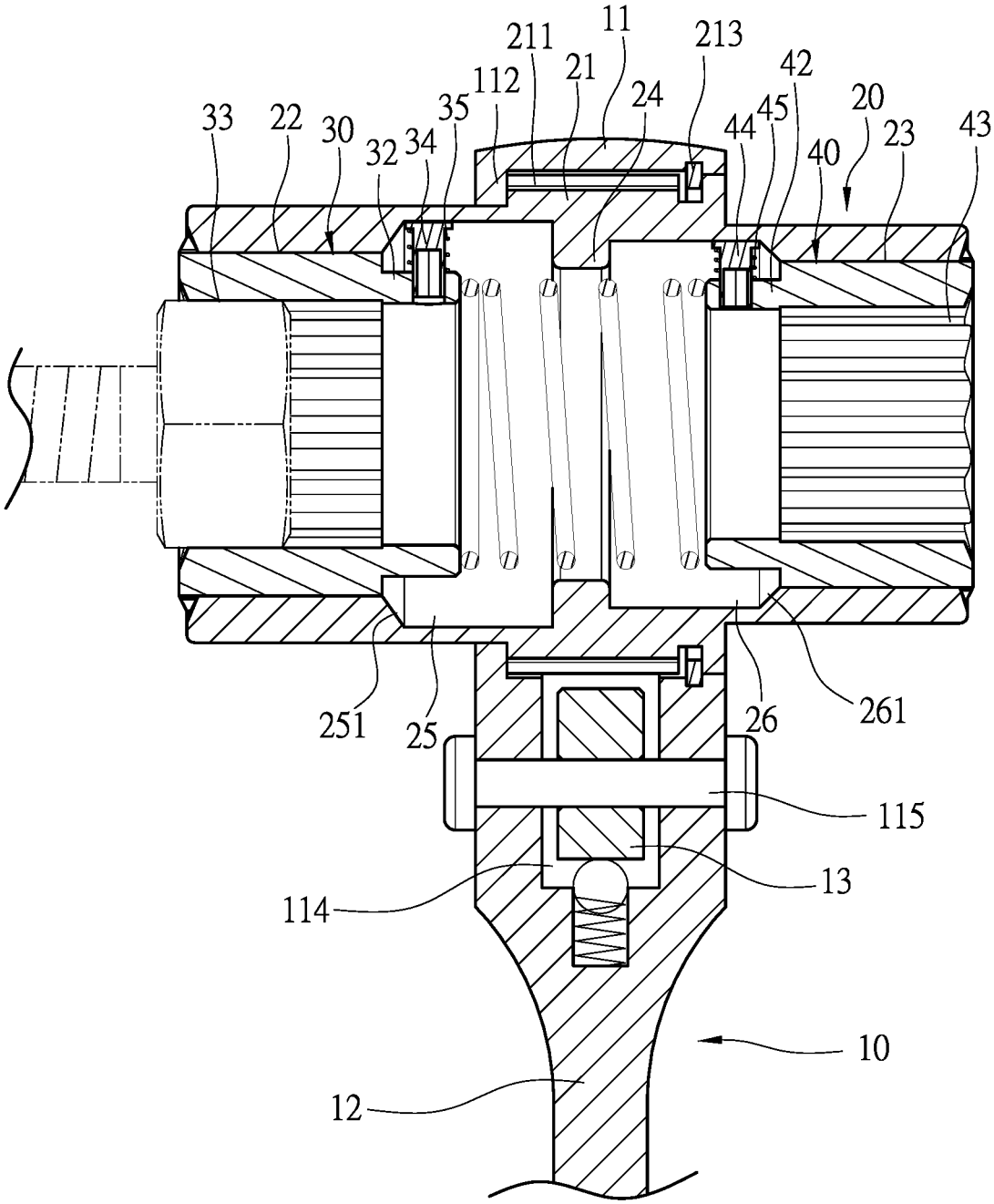
FIG. 7 is a schematic view illustrating a third tool hole on a first sleeve of the ratchet wrench of the present invention is in use.

In actual application, referring to FIGS. 3, 5 and 6, the four tool holes (22)(23)(33)(43) are all different in diameter, and the first sleeve (30) and the second sleeve (40) are adapted to be moved inwardly along the first tool hole (22) and the second tool hole (23) respectively, and the first locating column (34) and the second locating column (44) are configured to respectively abut against the blocking protrude (24) of the cylinder (20) so as to position the first sleeve (30) and the second sleeve (40). The first sleeve (30) and the second sleeve (40) are configured to compress the spring (27) to respectively form two engaging spaces at two open ends of the first tool hole (22) and the second tool hole (23), and the user can couple different tools on the engaging spaces to achieve the lock and release operations. In addition, referring to FIG. 7, tools can also engage on the third tool hole (33) of the first sleeve (30) and the fourth tool hole (43) of the second sleeve (40) to enable the ratchet wrench of the present invention to apply to four different diameters of tools.

Figure 8:
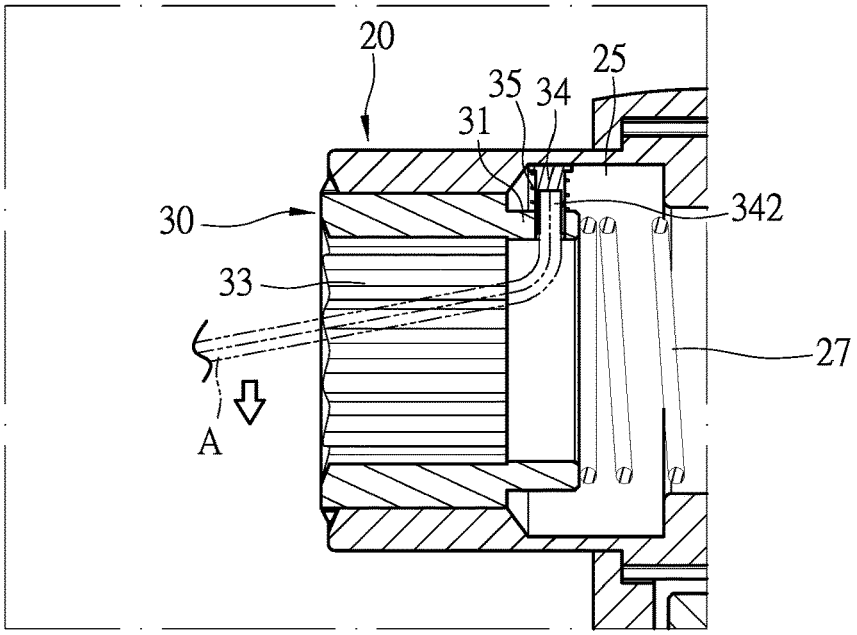
FIG. 8 is a schematic view illustrating the first sleeve is disassembled from the cylinder of the ratchet wrench of the present invention.
Figure 9:
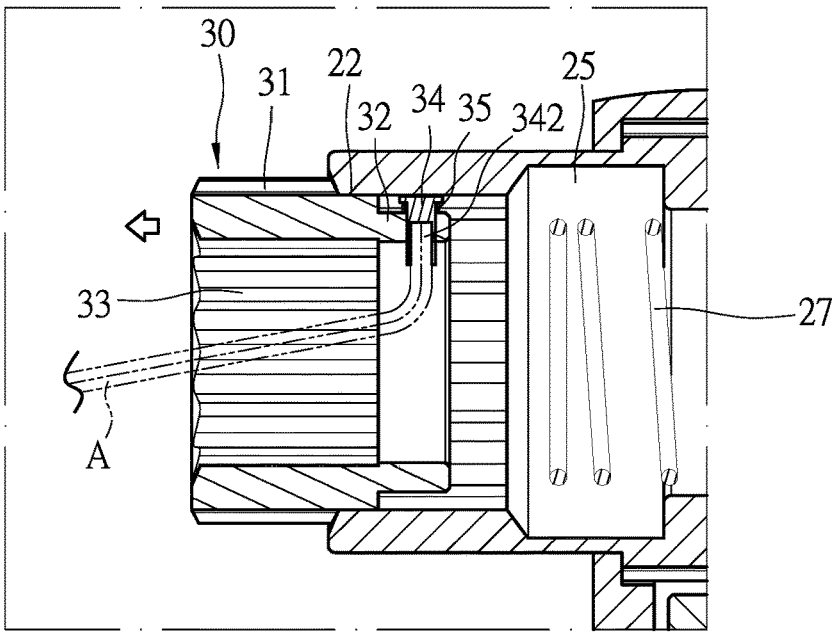
FIG. 9 is a schematic view illustrating the first sleeve is slid out of the first tool hole of the ratchet wrench of the present invention.

Furthermore, the first sleeve (30) and the second sleeve (40) are replaceable for the cylinder (20). This embodiment shows the first sleeve (30) is disassembled and replaced in FIGS. 8 and 9, and the second sleeve (40) can be disassembled and replaced in the same manner as the first sleeve (30). As the disassemble processing, an L-shape tool (A) is used, and an end of the L-shape tool (A) is inserted through the third tool hole (33) to engage with the first engaging hole (342) of the first locating column (34), and the L-shape tool (A) is configured to pull the first locating column (34) down to compress the first elastic piece (35), so that the first locating column (34) is detached from the first groove (25), and the first sleeve (30) can be pulled out of the first tool hole (22) and be changed into sleeves with different diameters of tool holes. As a result, the ratchet wrench of the present invention is not limited to connect to only four diameters of tool units that the sleeves (30)(40) are replaceable according to different uses, which greatly improves the practicability and convenience of the ratchet wrench.

Figure 10:
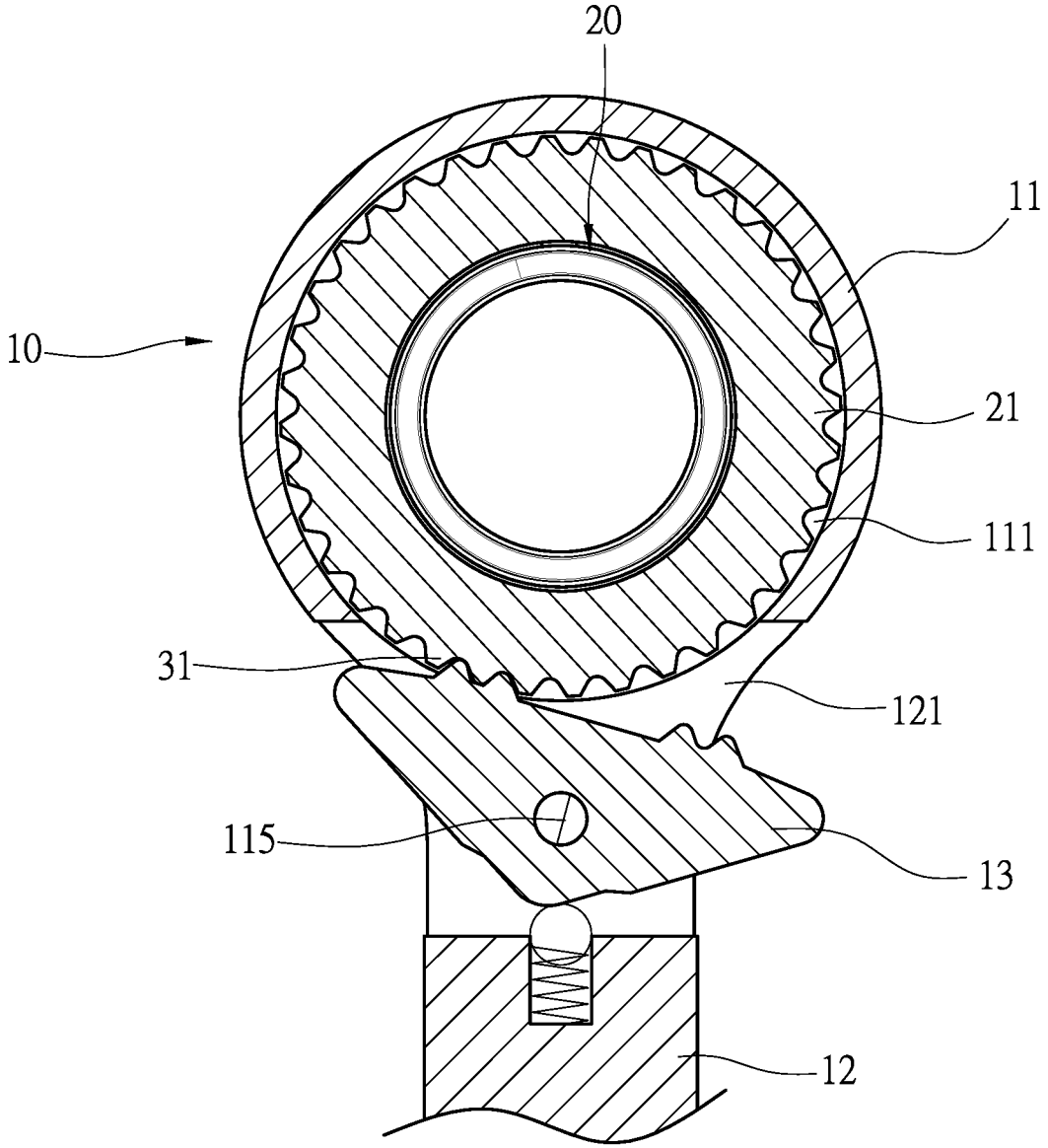
FIG. 10 is a sectional view illustrating a first teeth portion of the ratchet wrench is pulled through a second through hole to switch engaging side in the present invention.
Figure 11:
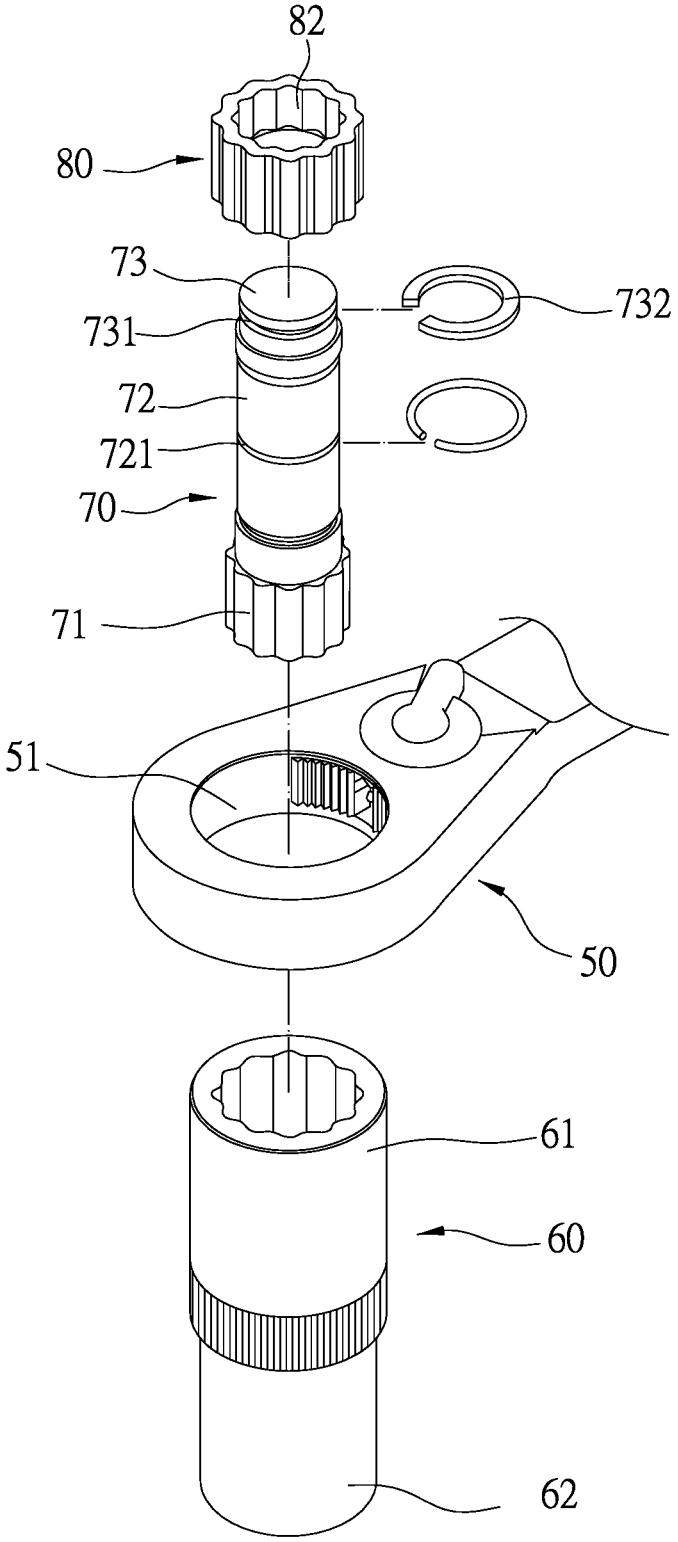
FIG. 11 PRIOR ART
FIG. 11 is a prior art.
Figure 12:
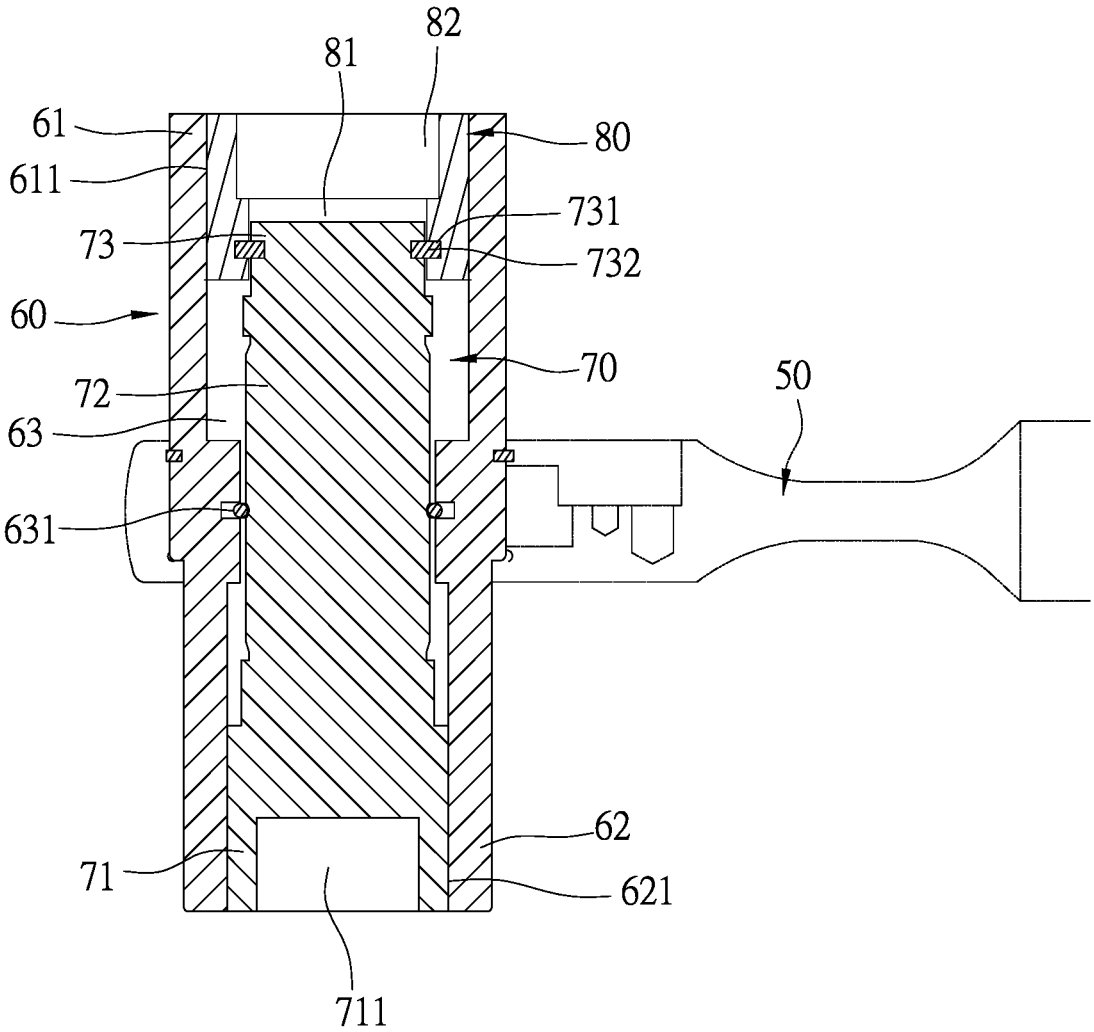
FIG. 12 PRIOR ART
FIG. 12 is a prior art.

Referring to FIG. 10, the second teeth portion (211) of the cylinder (20) is engaged with the first teeth portion (13) of the main body (10) so that the main body (10) is adapted to drive the cylinder (20), and the first teeth portion (13) is configured to be pulled through the second through hole (121) to switch engaging sides so as to achieve bidirectional ratchet effect, thereby improving the efficiency.

Comparing with conventional ratchet wrench, the present invention is advantageous because: the ratchet wrench of the present invention not only has four different diameters of tool holes (22)(23)(33)(43), but both of the first sleeve (30) and the second sleeve (40) are detachable from the cylinder (20) to install needed sleeves with different diameters of tool holes, which greatly increases the consumer purchasing intentions.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet wrench comprising a main body, a cylinder, a first sleeve, and a second sleeve;

wherein the main body has a head portion and a shank, and a first through hole horizontally penetrates through the head portion; the inner periphery of the first through hole has an accommodating slot at a position corresponding to the shank, and two lateral sides of the shank adjacent to the head portion respectively comprise two second through holes communicated with the accommodating slot; a first teeth portion is received in the accommodating slot, and two ends of the first teeth portion respectively protrude out from the two second through holes to enable a user to pull to adjust the position of the first teeth portion;

wherein the cylinder is coupled in the first through hole, and a middle portion of the outer periphery of the cylinder has a second teeth portion, and the second teeth portion having continuous teeth formed of a loop is adapted to engage with the first teeth portion; the inner peripheries of two ends of the cylinder respectively comprise continuous teeth to form a first tool hole and a second tool hole, which are formed in different diameters; an annular blocking protrude is formed at the middle portion of the inner periphery of the cylinder, and a first groove and a second groove are respectively formed between the blocking protrude and the first tool hole and between the blocking protrude and the second tool hole; the inner diameter of the first groove is larger than both of that of the first tool hole and that of the blocking protrude, and the inner diameter of the second groove is larger than both of that of the second tool hole and that of blocking protrude, and a spring is received in the cylinder;

wherein the first sleeve comprises a first outer teeth and a first annular surface on the outer periphery thereof, and the first outer teeth has continuous teeth formed of a loop; the inner periphery of the first sleeve comprises continuous teeth to form a third tool hole; the first sleeve is coupled in the first tool hole, and the first outer teeth is engaged with the continuous teeth of the first tool hole; the outer diameter of the first annular surface is smaller than that of the first outer teeth, and the first annular surface has at least a first slot thereon, and a first locating column is received in the first slot; the top end of the first locating column comprises a first blocking portion which has the outer diameter larger than that of the first locating column, and a non-circular first engaging hole is formed at the bottom end of the first locating column; a first elastic piece is disposed on the outer periphery of the first locating column, and the position of the first elastic piece is limited between the first blocking portion and the first annular surface, and the first locating column is pushed outwardly by the first elastic piece and limited between the first groove and the first slot, so that the first sleeve is slidably limited in the first tool hole; and wherein the second sleeve has a second outer teeth and a second annular surface on the outer periphery thereof, and the second outer teeth comprises continuous teeth formed of a loop; the inner periphery of the second sleeve has continuous teeth to form a fourth tool hole, and the third tool hole and the fourth tool hole have different diameters; the second sleeve is coupled in the second tool hole, and the second outer teeth is engaged with the continuous teeth of the second tool hole; the outer diameter of the second annular surface is smaller than that of the second outer teeth, and the second annular surface comprises at least a second slot thereon; a second locating column is received in the second slot, and the top end of the second locating column has a second blocking portion which has the outer diameter larger than that of the second locating column while a non-circular second engaging hole is formed at the bottom end of the second locating column; a second elastic piece is disposed on the outer periphery of the second locating column, and the position of the second elastic piece is limited between the second blocking portion and the second annular surface, and the second locating column is pushed outwardly by the second elastic piece and limited between the second groove and the second slot, so that the second sleeve is slidably limited in the second tool hole; and the first annular surface and the second annular surface are respectively abutted against two ends of the spring so as to limit the spring in the cylinder.

2. The ratchet wrench of claim 1, wherein an inclined first guiding surface is connected between the first groove and the first tool hole while an inclined second guiding surface is connected between the second groove and the second tool hole.

3. The ratchet wrench of claim 1, wherein a blocking edge protrudes from the inner periphery of an end of the first through hole, and the other end of the first through hole comprises a first annular groove on the inner periphery thereof; the cylinder has an annular first protrude on the middle portion of the outer periphery thereof, and the second teeth portion and a second annular groove are respectively formed on the surface of the first protrude; one end of the first protrude is abutted against the blocking edge, and the second annular groove on the other end of the first protrude is aligned with the first annular groove, and a C-shape ring is coupled between the second annular groove and the first annular groove to secure the cylinder in the first through hole.

4. The ratchet wrench of claim 1, wherein the first groove and the second groove have different inner diameters.

5. The ratchet wrench of claim 1, wherein the first locating column with the first elastic piece and the second locating column with the second elastic piece are respectively inserted into the first slot and the second slot.

* * * * *